United States Patent [19]

Wells, Jr. et al.

[11] 4,297,932

[45] Nov. 3, 1981

[54] CHEESECAKE CUTTING MACHINE

[75] Inventors: John J. Wells, Jr., 8818 Via Andar, San Diego, Calif. 92122; Donald R. Kleine, El Cajon, Calif.

[73] Assignee: John J. Wells, Jr., National City, Calif.

[21] Appl. No.: 133,115

[22] Filed: Mar. 24, 1980

[51] Int. Cl.[3] ..... B26D 3/24

[52] U.S. Cl. ..... 83/581.1; 30/114; 30/117; 83/620; 83/651.1

[58] Field of Search ..... 83/651.1, 581.1, 620; 30/114, 117

[56] References Cited

U.S. PATENT DOCUMENTS

| | | | |
|---|---|---|---|
| 1,657,483 | 1/1928 | Rabin | 83/651.1 X |
| 1,704,509 | 3/1929 | Miller | 30/117 X |
| 2,403,190 | 7/1946 | Parraga | 30/117 X |
| 2,824,588 | 2/1958 | Lyon et al. | 30/114 |
| 3,060,838 | 10/1962 | Priore | 30/114 X |
| 3,109,470 | 11/1963 | Urschel et al. | 83/581.1 X |
| 4,195,402 | 4/1980 | Leffer | 83/651.1 |

FOREIGN PATENT DOCUMENTS

| | | | |
|---|---|---|---|
| 63156 | 6/1926 | Sweden | 30/114 |

*Primary Examiner*—Frank T. Yost
*Attorney, Agent, or Firm*—Brown & Martin

[57] ABSTRACT

An apparatus for slicing a cheesecake into a plurality of neatly cut pie-shaped slices of equal size. It includes a cutting cylinder having a plurality of tensioned cutting wires each extending diametrically across the lower end of the cylinder. The wires are tied at their one ends to retaining pins and at their other ends to guitar tuning peg assemblies at respective annularly spaced, equally distant locations about the cylinder. The cutting cylinder is attached with releasable latches beneath a similar size guide cylinder, in end to end relation. The cutting and guide cylinders are suspended from a U-shaped yoke with their common central axis extending vertically. The side edges of the yoke slidably engage respective vertical tracks which extend from a horizontal planar base. The cutting cylinder can be vertically reciprocated about its vertical axis into and out of close proximity with the base. This permits the tensioned wires across the lower end of the cutting cylinder to neatly slice a cheesecake centrally supported above the base on a pedestal.

6 Claims, 5 Drawing Figures

CHEESECAKE CUTTING MACHINE

BACKGROUND OF THE INVENTION

The present invention relates to apparatus for slicing food products into a plurality of precisely shaped pieces. More particularily, the present invention relates to an improved food slicing apparatus utilizing tensioned wire cutting elements. The apparatus is adapted for rapidly slicing flat, cylindrical food products such as cheesecakes into a plurality of neatly cut pie-shaped pieces of equal size.

In the past, food slicing apparatus have existed which have utilized tensioned wire cutting elements. In one such apparatus adapted for slicing cheese, a single tensioned wire is spaced closely adjacent to a parallel elongate roller. The wire and the roller are mounted on the remote end of a handle. In another such apparatus also adapted for slicing cheese, a U-shaped lever is pivotably attached to a cutting board. A single tensioned wire extends between the legs of the lever. Downward swinging of the lever causes the tensioned wire to cut a slice from a block of cheese supported on the cutting board.

Other such slicing apparatus heretofore known have incorporated a plurality of tensioned wires elements arranged in a predetermined array for slicing or cutting fruit, vegtables, or other food products into a plurality of uniformly dimensioned slices. For example, one such apparatus is adapted for slicing french fries from a peeled potato. It includes a square-shaped frame having a relatively large cut-out region in its center. Two perpendicular rows of spaced apart tensioned wire elements criss-cross the cut-out region. These wires are tightly secured at their ends to the frame. This apparatus may be forced down over the peeled potato to produce a plurality of potato segments each having a uniform cross-sectional area. Similar apparatus have also existed heretofore for cutting fruit into precise slices suitable for decorative cuisine.

A number of food products are configured in the shape of a relatively large, flat cylinder. Examples are cheesecakes, and wheels of very soft cheese such as Brie. Typically, these food products are served or divided by slicing them into a plurality of pie-shaped slices. They have a soft consistency or texture which enables them to be neatly sliced by wire cutting elements under suitable tension. Oftentimes for saleability, it is desirable that the slices appear neatly cut. Furthermore, due to the relatively high cost of such food products, it is desirable to carefully control the size and weight of individual slices. Heretofore cheesecakes and cheese wheels and other similarly shaped food products of like consistency have typically been sliced by hand using a large knife. This manual slicing process is not only time consuming but frequently results in slices in unequal size. Furthermore, in the case of cheesecakes, slices which are manually cut using a knife are often not symmetrical.

There has existed in the prior art one apparatus for facilitating the scoring of cheesecakes into pie-shaped slices of uniform size. It incorporates an open ended metal cylinder having a relatively small height and a diameter slightly larger than the diameter of the cheesecake. A plurality of tensioned wire cutting elements extend diametrically across the cylinder and are secured at their opposite ends adjacent the upper end of the cylinder. The wire attachment point are annularly spaced about the cylinder equal distances apart. The wire elements all intersect in the center of the cylinder. This device has not been used for slicing the cheesecake but has instead been impressed onto the upper surface of the cheesecake so that the tensioned wires could score a pattern thereon. Thereafter, the cylinder with the tensioned wires has been removed so that the scoring could be utilized as a pattern for cutting slices from the cheesecake with a knife.

The aforementioned apparatus utilized for scoring cheesecakes is not readily adapted for slicing the cheesecakes. There is insufficient clearance between the cylinder and the cheesecake and no easy manner of grasping the cylinder and pushing it down through the cheesecake. Furthermore, even if such manual pushing were to be utilized, there is no way to insure precise vertical downward and upward movement of the individually positioned wires. Thus, if slices are attempted to be produced with this apparatus, their edges are often non-uniform and jagged. Furthermore, the tensioned wires on this apparatus have been securely fixed. It has not been possible to adjust their tension readily. There must be sufficient tightness in the cutting wires in order to accomplish neat cutting. Thus in this known scoring apparatus, if any of the wires have become loose by stretching or otherwise it has not been possible to readily correct this defect. The wires have been tied at their ends to the rim of the cylinder and ready removal and replacement thereof has not been possible.

SUMMARY OF THE INVENTION

It is therefore a primary object of the present invention to provide an improved food slicing apparatus of the tensioned wire type.

Another object of the present invention is to provide an apparatus for slicing cylindrical foods products such as cheesecakes and cheese wheels into a plurality of neatly cut pie-shaped slices of equal size.

Still another object of the present invention is to provide a cheesecake slicing apparatus having tensioned wire cutting elements which can be rapidly replaced.

Yet another object of the present invention is to provide an apparatus for slicing a cylindrical food product into a plurality of pie-shaped slices in which a special array of tensioned wire cutting elements which intersect a common vertical axis is vertically reciprocated through the food product.

Yet another object of the present invention is to provide a food slicing apparatus of the aforementioned character in which the number of slices can be rapidly changed.

According to the preferred embodiment of the slicing apparatus disclosed herein, an open ended cutting cylinder has a plurality of tensioned wires which extend diametrically thereacross adjacent its lower end. The ends of the wires are annularly spaced about the cutting cylinder equal distances apart and each intersects the central axis of the cylinder. One end of each of the wires is secured to the corresponding adjustable tensioning means mounted to the cylinder which in preferred form comprises a guitar tuning peg assembly.

A support mechanism is provided for allowing vertical reciprocation of the cutting cylinder along its central axis so that the tensioned wires can be forced through the cheesecake in strict alignment. A plurality of neatly cut pie-shaped slices of equal size are formed.

The support mechanism includes a horizontal planar base from which extends a pair of spaced apart vertical tracks. An open ended guide cylinder having substantially the same diameter as the cutting cylinder has a U-shaped yoke mounted on its upper end. The yoke has side edges slidably engaged with respective ones of the tracks so that the guide cylinder can be vertically reciprocated about its central axis toward and away from the base. Releaseable latch means which may take the form of luggage-latches are provided for attaching the cutting cylinder beneath the guide cylinder so that the respective central axes of the cylinders coincide. The cutting cylinder is attached to the guide cylinder so that the tensioned wire cutting elements strung across its lower end face the planar base.

The assembly of cylinders can be vertically reciprocated to slice a cheesecake centrally positioned on a pedestal on the base into equal size pie-shaped slices. A cross bar connects the upper ends of the tracks. A releaseable clamp mechanism is provided for holding the yoke and the cross bar together to retain the guide and cutting cylinders in their uppermost positions. The guitar tuning peg assemblies allow rapid adjustment of the tension of the cutting wires and rapid replacement of broken wires. The latches on the guide cylinder enable the cutting cylinder to be quickly removed and replaced with a like cutting cylinder having a different number of wires for cutting a food product into a different number of slices.

BRIEF DESCRIPTION OF THE DRAWINGS

The aforementioned objects and advantages, as well as others, will become more apparent by way of the following detailed description of the preferred embodiment of the invention taken in conjunction with the accompanying drawings in which.

DESCRIPTION OF THE PREFERRED EMBODIMENT

Figure 1:
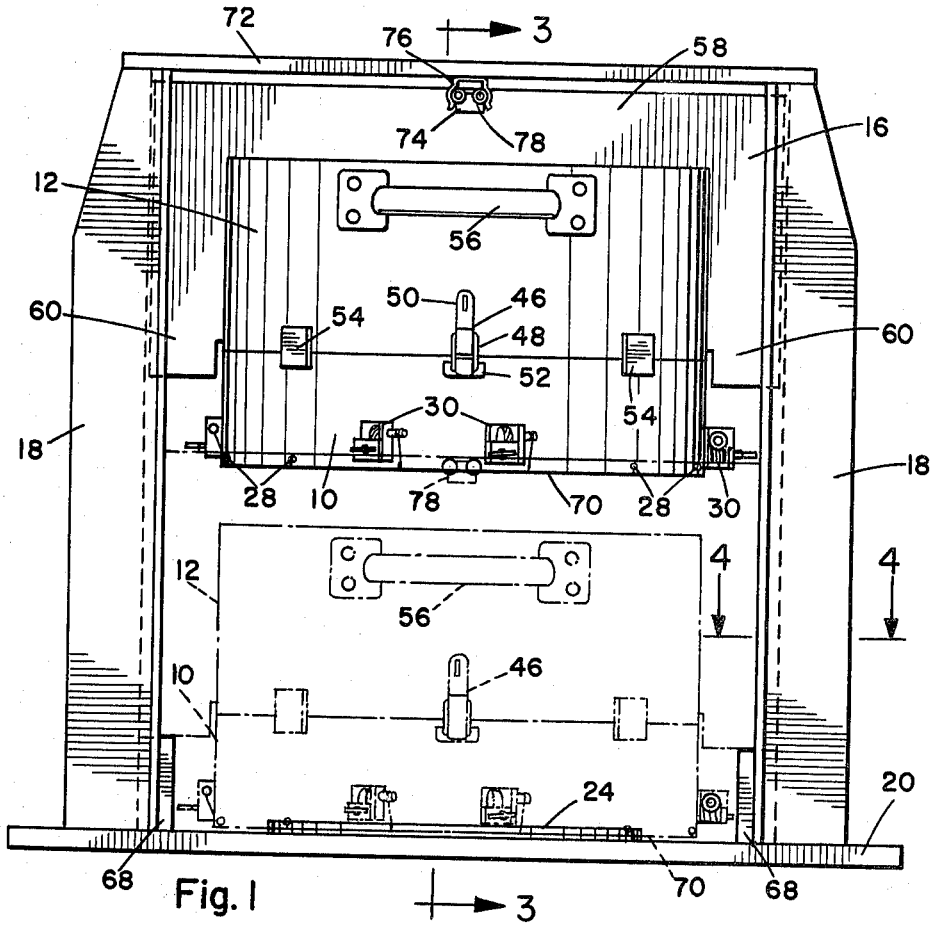
FIG. 1 is a side elevational view of the complete apparatus showing the raised and lowered positions of the cylinders and yoke in solid lines and phantom lines respectively.

Referring to FIG. 1, there is illustrated therein a preferred embodiment of a complete form of the apparatus of the present invention. Broadly, the apparatus shown includes a cylindrical cutting cylinder 10 which is attached beneath a guide cylinder 12 of like diameter in end to end fashion. An array of tensioned wires 14 (FIG. 2) are strung diametrically across the lower end of the cutting cylinder 10. The joined cylinders 10 and 12 (FIG. 1) are suspended from a yoke 16 whose side edges are slidably engaged with respective ones of a pair of vertically extending, spaced apart tracks 18. The tracks are in turn rigidly secured at their lower end to a horizontal planar base 20. Vertical reciprocation of the cylinders 10 and 12 between their relative uppermost and lowermost positions shown in solid and phantom lines respectively in FIG. 1 results in the slicing of a cylindrical food product. The food product may be a cheesecake 22 (FIG. 3) centrally positioned with respect to the axes of the cylinders and supported on a ring-shaped pedestal 24 supported on the base 20.

The structure of the various components of the apparatus and the manner in which they cooperate will now be described in detail. Throughout the Figures, like reference numerals refer to identical parts. Preferably, the components and mechanics hereafter described are made of stainless steel as in the case of other commercial kitchen equipment of high quality. However, in order to reduce the cost of the apparatus, plastic and other light weight, strong materials can be substituted within the limits dictated by strength requirements and wear factors. As used herein, the term "diametrically" shall mean that the tensioned wires 14 (FIG. 2) extend across the cutting cylinder 10 as diameters of its circular cross-section. In other words, the tensioned wires each intersect the central axis of the cylinder and a center point of one of its circular cross-sections.

Figure 2:
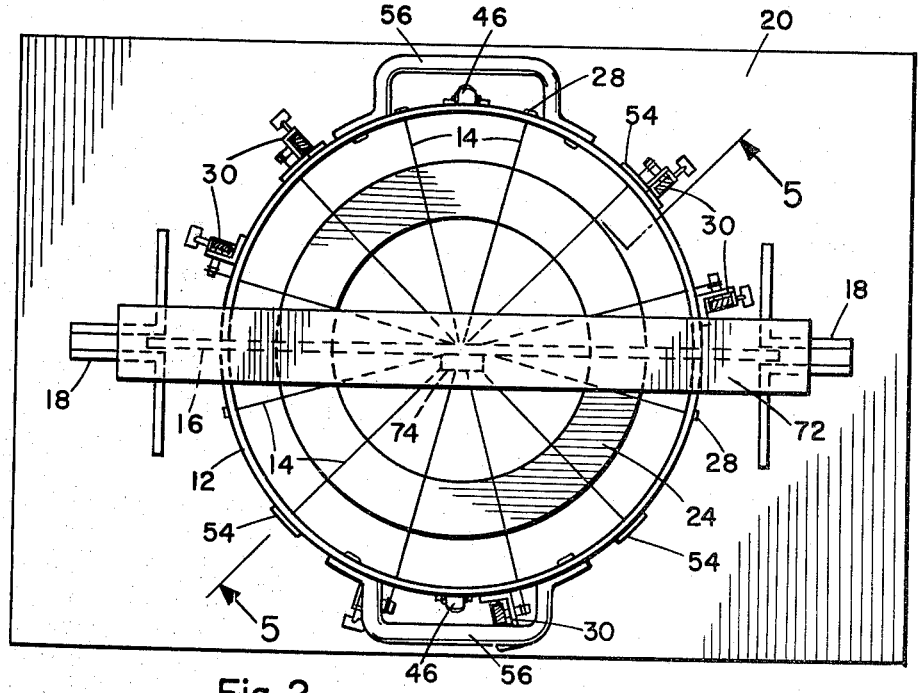
FIG. 2 is a top plan view of the apparatus of FIG. 1.
Figure 3:
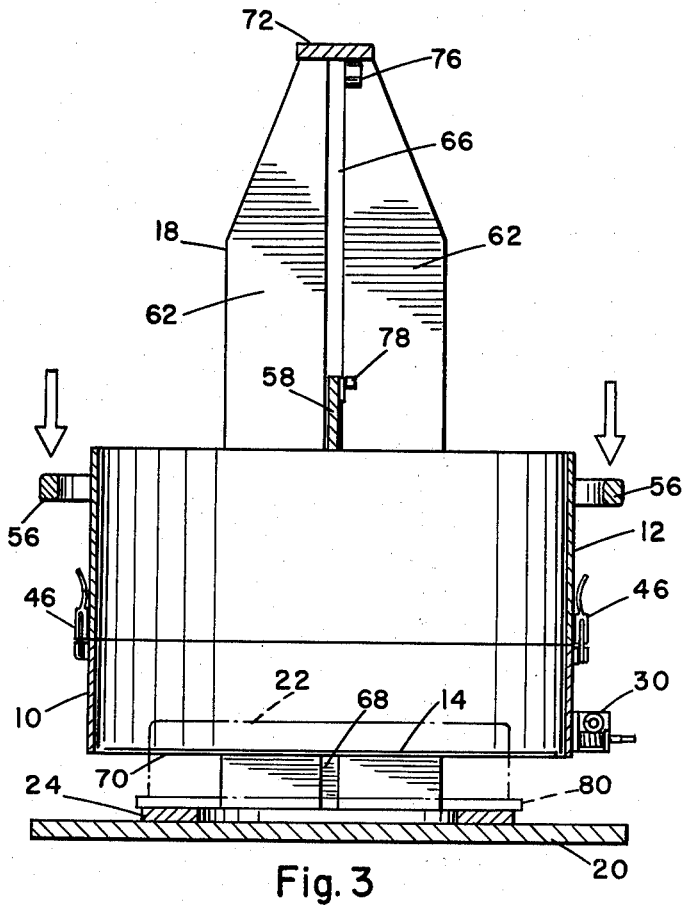
FIG. 3 is a vertical sectional view of the complete apparatus taken along line 3—3 of FIG. 1, with the cylinders and yoke shown in their partially lowered positions.

The cutting cylinder 10 (FIGS. 1 and 2) is open ended and has a vertically extending annular wall of a relatively small height, e.g two to four inches. This cylinder may have a suitable diameter such as twelve inches. It will be understood that both the height and the diameter of the cutting cylinder 10 can be varied widely, the only limitations being that the diameter must be sufficiently large so that there will be adequate clearance between its annular wall and the outer periphery of the cheesecake being sliced as shown in FIG. 3.

Figure 5:
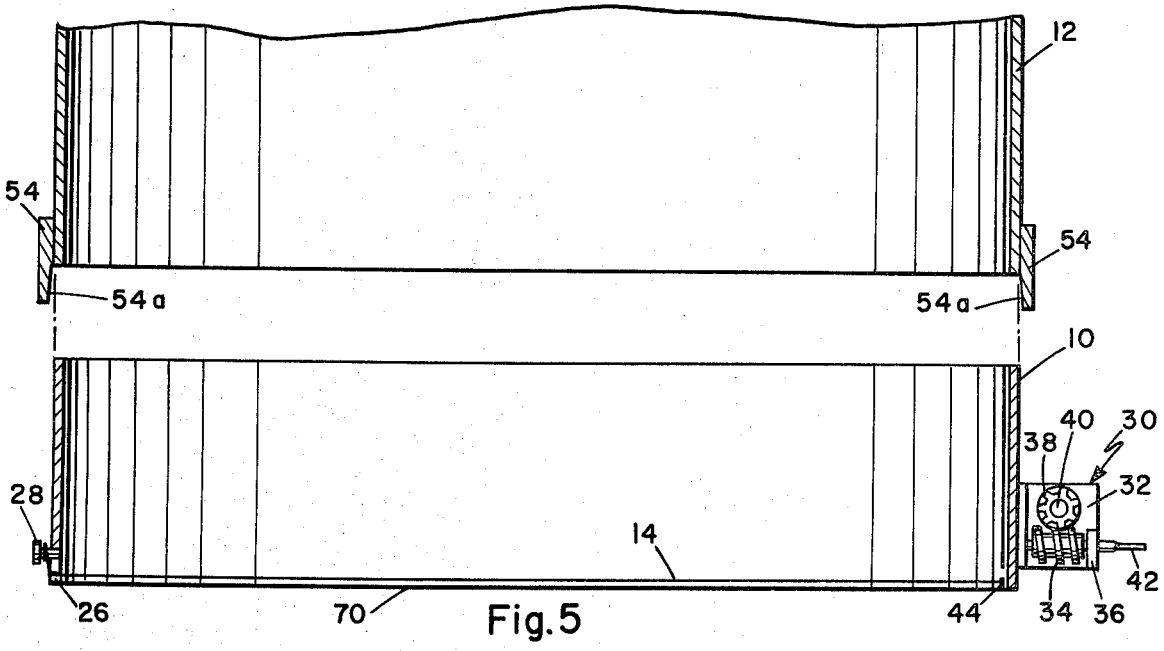
FIG. 5 is a fragmentary, enlarged vertical sectional view taken along line 5—5 of FIG. 2, showing the cutting cylinder separated from the guide cylinder.

A plurality of wire retaining means are mounted on the cutting cylinder 10 for securing the one end of a plurality of small gauge wires at respective annularly spaced locations about the cutting cylinder 10. One suitable retaining means is best seen in FIG. 5. There, one end of one of the wires **14*a* is received in a suitably positioned recess 26 cut in the lower end of the cylinder 10. This end of the wire 14*a* is further tied about a pin 28 having a shank rigidly secured in a hole in the annular wall of the cylinder 10 and a head for preventing the tied portion of the wire from being pulled from the pin. As shown in FIG. 2, the pins 28 are secured at annularly spaced positions about the cylinder 10. There are a total of six pins in the embodiment illustrated and in FIG. 2**, two of these pins are not visible.

A plurality of adjustable tensioning means are mounted on the cutting cylinder 10 for holding the other ends of the wires 14 so that they extend tightly across the cutting cylinder. These tensioning means are annularly spaced about the cutting cylinder adjacent its lower end so that each wire extends from the pin 28 across the cylinder diametrically. In the illustrated embodiment, the adjustable tensioning means comprise conventional guitar tuning peg assemblies 30 (FIG. 5). Each such assembly includes a L-shaped bracket 32 whose one flange is secured in overlapping relationship with the annular wall of the cutting cylinder 10. A worm gear 34 is rotatably mounted between the one flange of the bracket and a bearing plate 36 orthogonally secured to the other flange of the bracket. A pinion gear 38 is rotatably mounted on the other flange of the L-shaped bracket and intermeshes with the worm gear 34. The pinion gear 38 is supported on an axle 40, the remote end of which has a hole drilled therethrough (not visible in FIG. 5) which receives the other end of the wire **14*a*. An individual can grasp the key 42 of the tuning peg assembly between his or her thumb and index finger in order to rotate the worm gear 34 and thus slowly rotate the axle 40**. It will be understood that the tuning peg assembly may be of the conventional type normally used on the heads of the guitars and other string instruments for tightening and untightening the strings thereof.

Small gauge steel wires can thus be readily installed on the cutting cylinder merely by tying one end around a pin 28. The other loose end is threaded through a recess such as 44 (see FIG. 5) diametrically opposite the chosen pin and through the hole of the axle 40 of the assembly 30. Thereafter, the wire can be quickly tightened by turning the key 42. Relatively greater amounts of tension can be easily imparted to each of the wires 14. This is desirable since relatively great amounts of tension will insure that the wires 14 deflect a minimum amount out of plane during the slicing operation. As will become apparent, minimal deflection of the wires during the slicing operation insures that the cheesecake will be sliced completely through by each one of the wires over the complete length of each wire. Without this type of cutting, portions of the crust of the cheesecake might remain uncut. When the slices are subsequently removed, these uncut portions can tear away leaving jagged and unsightly edges.

As seen in FIG. 2, a plurality of guitar tuning peg assemblies 30 are secured to the outer surface of the cutting cylinder 10 in annularly spaced locations. It will be noted that the axles 40 of these assemblies preferrably extend perpendicular to the axis of the cylinder 10 and they are positioned relative to the recessess 44 as shown in FIG. 1 so that the other ends of each of the wires 14 can be readily wound thereabout. Due to the well known intermeshing relationship of the spur and pinion gears of each one of these assemblies, the pulling forces exerted by the wires on their axles will not result in unwinding and loosening of the wires after tightening.

As shown in FIG. 2, the pins 28 and the tuning peg assemblies 30 are annularly spaced about the cutting cylinder 10 and are spaced equal distances apart so that the horizontal area between adjacent radius segments of the wires 14 is equal. This in turn insures that the slices into which the cheesecake is cut are equal in size.

The guide cylinder 12 (FIG. 1) has a diameter equal to that of the cutting cylinder 10 and a slightly greater vertical height. Releaseable latch means are provided for attaching the cutting cylinder beneath the guide cylinder so that their respective central axes coincide and so that the lower end of the cutting cylinder faces the base 20. Suitable for this purpose are luggage latches 46 (FIGS. 1 and 2) which are positioned on opposite sides of the cylinders 10 and 12. These latches are well known and are often seen on tool chests, luggage and the like.

As shown in FIG. 1, luggage latch 46 includes a U-shaped clip 48 which is swingably attached to a lever 50 pivotably secured to the upper cylinder 12. A cleat 52 is secured to the lower cylinder 10. The cylinders 10 and 12 can be secured in end to end relation by swinging the lever 50 downwardly and by positioning the U-shaped clips about their corresponding cleats 52. Thereafter, the lever 50 can be swung upwardly against the annular wall of the guide cylinder 12, thus tightly clamping the clips 48 against their respective cleats. A wide variety of other releaseable latches means could be utilized. The feature that is desired is rapid replacement of the cutting cylinder 10.

A plurality of vertically extending flanges 54 (FIGs. 1 and 5) are secured to the outer periphery of the guide cylinder 12. These flanges extend below the lower end of the guide cylinder and their inner surfaces 54*a* diverge outwardly moving in a downward direction. These flanges overlap the outer periphery of the upper end of the cutting cylinder when the cutting cylinder and the guide cylinder are secured in end to end relationship as shown in FIG. 1. Thus, during replacement of the cutting cylinder, these flanges facilitate the proper end to end alignment of the cylinders and further serves to maintain their co-axial relationship during the tightening of the luggage latches 46 and during the actual slicing operation.

A pair of handles 56 are riveted to opposite sides of the guide cylinder 12. They may be firmly grasped by the right and left hands of the user for forcing the cutting cylinder downwardly about the cheesecake and the wires carried thereby downwardly through the cheesecake.

The guide cylinder 12 is suspended from and carried by the yoke 16 (FIG. 1). The yoke is flat, U-shaped vertically extending piece. It has a horizontally extending cross-portion 58 which extends diametrically across the upper end of the guide cylinder as shown in FIG. 2. The yoke further has two downwardly extending legs 60, the inner edges of which are secured to the outer annular wall of the guide cylinder 12 and the outer side edges of which are slidably engaged in respective ones of the tracks 18. The yoke thus carries the assembly of cylinders and provides a means for permitting non-tilting reciprocal movement of the cutting cylinder through and away from the cheesecake.

Figure 4:
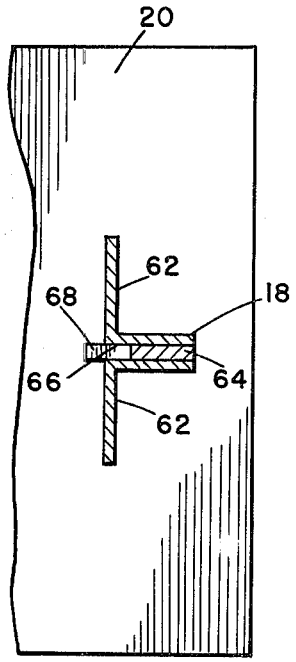
FIG. 4 is a fragmentary horizontal sectional view taken along line 4—4 of FIG. 1.

The construction of the tracks 18 is illustrated in detail in FIG. 4. Each track includes a pair of vertically extending L-beams 62 having opposing parallel legs which are held apart by spacers, such as 64. The L-beams 62 define therebetween a vertically extending slot 66 (visible in FIG. 4). The bottoms of the respective slots defined by each of the tracks 18 are shown in phantom lines in FIG. 1. The side edge portions of the legs 60 of the yoke slide in respective ones of the slots defined by the tracks 18. At the bottoms of the tracks, portions of the spacers 64 jut outwardly to define stops 68. These stops engage the lower end edges of the legs 60 of the yoke to limit the downward movement thereof. Preferrably, the height of the stops 68 is sufficient so that when the cylinders are at their lower limits of movement, the lower end edge 70 (FIG. 1) of the cutting cylinder 10 is slightly above the upper surface of the base 20. This prevents the cutting cylinder 10 from banging into the base.

A cross-bar 72 (FIGS. 1 and 3) connects the upper ends of the tracks 18 and serves to hold them in rigid parallel relationship. Releaseable clamp means are provided for holding the yoke 16 and the cross-bar together. This enables the cylinders to be locked in their uppermost positions so that the user can replace a cheesecake on the base at the conclusion of the cutting operation. One suitable releaseable clamp means may be the type that is typically used for holding kitchen cabinets shut. As best seen in FIG. 1, such a clamp 74 includes a springy, U-shaped bracket 76 which is secured to the underside of the cross bar 72. A pair of spaced apart nylon rollers 78 are secured to the center of the cross-portion 58 of the yoke in vertical alignment with the springy bracket 76. Thus, when the yoke and the cylinders suspended therefrom are moved to their upper limits of movement, i.e. when the upper edge of the yoke comes into proximity with the cross-bar 72, the rollers 78 become clamped between the springy curved legs of the brackets 76. This holds the yoke and the cutting and guide cylinders in their uppermost positions. When the user applies a suitable amount of downward force on the handles 56, the rollers will snap free from the springy bracket and the cutting and guide cylinders can be moved downwardly.

Finally, it will be noted that the ring-shaped pedestal 24 is secured in horizontal overlapping relationship with the base 20 as shown in FIGS. 2 and 3. Its diameter is preferrably smaller than the inside diameter of the cutting cylinder. This enables the lower end of the cutting cylinder to be moved downwardly below the upper surface of the pedestal as seen in FIG. 1. This relationship facilitates the slicing of the cheesecake completely through its crust. Preferably, the cheesecakes when sliced are supported on a resilient plate 80 (FIG. 3) made of a material such as cardboard. This plate also has a diameter which is preferably less than the inner diameter of the cutting cylinder 10. The cutting cylinder can be moved downwardly so that the tensioned wires 14 pass completely through the cheesecake including its crust until they engage and slightly depress the cardboard plate 80. This insures that the cheesecake is completely sliced through. The pedestal 24 should be positioned within the walls of the cutting cylinder and should have a height sufficient to insure complete cutting through of the cheesecake upon a predetermined amount of downward reciprocation of the guide and cutting cylinders.

A highly advantageous feature of the present invention is that the cutting cylinder can be quickly replaced with another having a different diameter or a different number of tensioned wires. Thus, the apparatus can be quickly adapted for cutting various sizes of cheesecakes, cheese wheels and other similarily configured and textured food products. Furthermore, the number and size of slices can be quickly varied in this manner. Another key feature is that broken wires can be quickly replaced thus greatly reducing the amount of time that the apparatus is inoperable.

Having described a preferred embodiment of the slicing apparatus, it should be apparent that the present invention permits modification in both arrangement and detail. For example, substitutions could readily be made for the guitar tuning peg assemblies, luggage latches, and kitchen cabinet type clamp. However, it is convenient to use these mechanisms because they are widely available at relatively low cost. The present invention should be limited only in accordance with the scope of the following claims.

We claim:

1. A slicing apparatus comprising:

an open ended cutting cylinder;

a plurality of wires, each being longer than the diameter of the cutting cylinder;

a plurality of wire retaining means mounted on the cutting cylinder for securing the one ends of the wires at respective annularly spaced locations about the cutting cylinder;

a plurality of adjustable tensioning means mounted on the cutting cylinder for holding the other ends of the wires tightly across the cutting cylinder, the tensioning means being annularly spaced about the cutting cylinder so that each wire extends substantially diametrically across the cutting cylinder, through its central axis; and means for supporting the cutting cylinder for vertical reciprocation along the central axis of the cutting cylinder, including:

a generally horizontal planar base, a pair of spaced apart vertically extending tracks mounted on the base, an open ended guide cylinder having substantially the same diameter as the cutting cylinder, a yoke mounted to the guide cylinder and having side edges slidably engaged with respective ones of the tracks so that the guide cylinder can be vertically reciprocated about its central axis, and releasable latch means for attaching the cutting cylinder beneath the guide cylinder with the central axes of the cylinders in substantial alignment.

2. A slicing apparatus according to claim 1 and further comprising:

a cross bar connecting the upper ends of the tracks; and releasable clamp means for holding the yoke and the cross bar together.

3. A slicing apparatus according to claim 1 and further comprising handle means mounted on the guide cylinder for facilitating manual downward movement thereof.

4. A slicing apparatus according to claim 1 and further comprising a plurality of vertically extending flanges secured to the outer periphery of the guide cylinder and extending below its lower end for facilitating alignment of the cutting and guide cylinders.

5. A slicing apparatus according to claim 1 wherein;

the wires extend diametrically across the cutting cylinder adjacent its lower end; and the base includes a pedestal which is positioned within the cutting cylinder upon a predetermined amount of downward reciprocation of the guide and cutting cylinders.

6. A slicing apparatus comprising:

an open ended cutting cylinder having a central axis, an annular wall, an upper end, a lower end, and a predetermined diameter;

a plurality of wires each being longer than the predetermined diameter;

a plurality of wire retaining means mounted on the cutting cylinder for securing the one ends of the wires at respective annularly spaced locations about the cutting cylinder adjacent its lower end;

a plurality of adjustable tensioning means mounted on the cutting cylinder for holding the other ends of the wires so that they extend tightly across the cutting cylinder, the tensioning means being annularly spaced about the cutting cylinder adjacent the lower end thereof so that each wire extends substantially diametrically across the cutting cylinder through its central axis;

a generally horizontal planar base;

a pair of spaced apart vertically extending tracks mounted on the base;

an open ended guide cylinder having a central axis, an annular wall, an upper end, a lower end, and a diameter substantially equal to the predetermined diameter;

a yoke mounted to the guide cylinder and having side edges slidably engaged with respective ones of the tracks so that the guide cylinder can be vertically reciprocated about its central axis toward and away from the base; and releasable latch means for attaching the cutting cylinder beneath the guide cylinder with their respective central axes in substantial alignment and with the lower end of the cutting cylinder facing the planar base.

* * * * *